United States Patent [19]

Makabe

[11] Patent Number: 4,494,269

[45] Date of Patent: Jan. 22, 1985

[54] HAIRBRUSH DEVICE

[76] Inventor: Seigo Makabe, 543 Toyano, Niigata, Japan

[21] Appl. No.: 165,022

[22] Filed: Jul. 1, 1980

[51] Int. Cl.[3] ..... A46B 9/10

[52] U.S. Cl. ..... 15/203

[58] Field of Search ..... 15/159 A, 203, 186–188, 15/184; 132/119–123, 160, 151

[56] References Cited

U.S. PATENT DOCUMENTS

| | | | |
|---|---|---|---|
| Re. 26,403 | 6/1968 | Kutik | 15/187 |
| 2,139,709 | 12/1938 | Yaw | 132/161 |
| 2,486,203 | 10/1949 | Pieper | 15/203 |
| 2,981,965 | 5/1961 | Kaye et al. | 15/187 X |
| 3,947,914 | 4/1976 | Jacoby | 15/203 |
| 4,028,768 | 6/1977 | Pascal | 15/203 |
| 4,103,387 | 8/1978 | Anetseder, Jr. et al. | 15/203 |
| 4,121,314 | 10/1978 | Nathe | 15/203 |

*Primary Examiner*—Peter Feldman

*Attorney, Agent, or Firm*—Koda and Androlia

[57] ABSTRACT

A hairbrush device composed of upper wall, lower wall and movable flat board, and by the back and forth movement of the movable flat board, the brush tips can be raised up or pushed down. A stopper member is provided so as to fix the brush tips vertically for operation.

5 Claims, 7 Drawing Figures

HAIRBRUSH DEVICE

BACKGROUND OF THE INVENTION

1. Field of the Invention

This invention relates to a hairbrush, the shaped brush tips of which can be raised up or pushed down by the back and forth movement of the handle, the hairbrush being handy for carrying.

2. Prior Art

Heretofore as a hairbrush of this kind, a Japanese opening publication No. 53-99663 has been proposed. This hairbrush comprises a lot of shaped brush tips from the base board through the cover board, which have to be arranged one by one individually. In order to give rise and fall movement for the brush tips by back and forth movement of the cover board, this hairbrush also comprises bone end parts, rolling axises and openings, and through the openings bone end parts are thrusted and joints are formed.

However this hairbrush was very complex in structure and was expensive in production. This hairbrush was weak against impacts and ordinary operation was easily subject to damage. Besides, on account of the separate structure of each brush tips, it took a long time for the production and resulted in high cost. Moreover, a U shaped handle, which is free to rise up or fall down is provided at the middle of the base board, and in time of use T shaped hairbrush is formed. When the hairbrush is used with the U shaped handle gripped, fingers will be put to the middle of the hairbrush and will be blown hot by a hair dryer, which proves to be inconvinient for use.

SUMMARY OF THE INVENTION

This invention is composed of tripple structure of upper wall 2*a*, movable flat board 5 and lower wall 2*b*. Along with back and forth movement of the movable flat board 5 guided by the upper and lower walls 2*a*, 2*b*, the lower ends of the shaped brush tips which are engaged in the movable flat board 5 by the interposition of axles also move with the movable flat board 5, thus causing the brush tips to rotate and the brush tips rise or fall down.

Therefore, it is a primary object of this invention to provide a hairbrush which is strong against impacts. Another object of this invention is to provide a hairbrush which can be produced with less time and cost. Still another object of this invention is to provide a handle which is located at a position not to be blown hot by a hair dryer.

The foregoing objects and other objects as well as the characteristic features of this invention will become more apparent and more readily understandable by the following description and the appended claims when read in conjunction with the accompanying drawings.

DETAILED DESCRIPTION OF THE INVENTION

Figure 1:
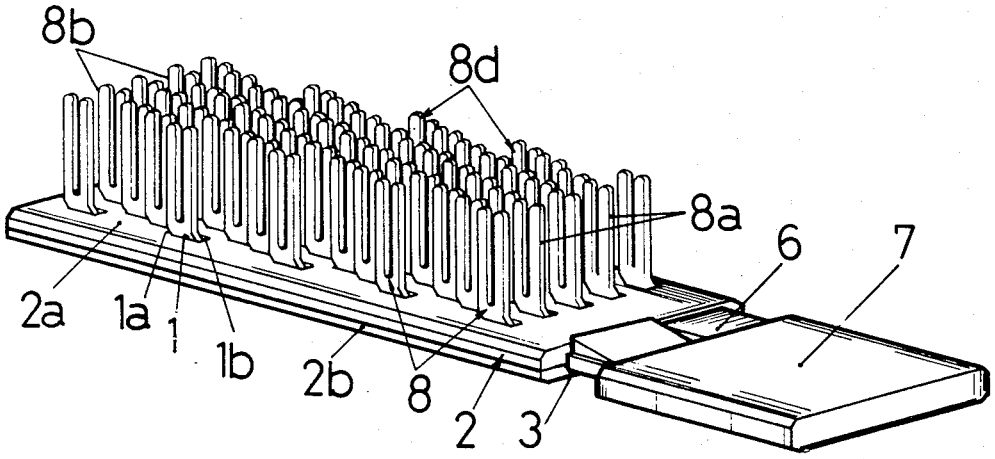
FIG. 1 is a perspective view of the hairdryer device according to one embodiment of the present invention.

A main brush body 2 posessing upper wall 2*a* and lower wall 2*b* is provided, and in the hollow part 4 of this main brush body 2 a movable flat board is inserted which is shorter than the main brush body 2 and movable both forward and backward, and to this movable flat board transverse axles 10 of equal intervals and of about the same length with that of movable flat board are coupled. At the end of this movable flat board 5 a handle 7 is provided in a straight line with the interposition of connecting part 6 which includes a stopper 6*a*. A plurality of guide holes 1 are provided in the form of longitudinal slots in the upper wall 2*a*, which face down toward the axles 10 from said upper wall 2*a*, and through these guide holes 1 short brush legs 8*c* of the brush tips are thrusted and the lower edges are united to the axles 10 and by the back and forth movement of the handle each brush tip is made to rise up or fall down by engaging respectively with the front wall 1*a* or back wall 1*b* of guide hole 1.

In the drawings, 3 indicates penetrating hole for the connecting part 6 which is provided to the main brush body, 11 indicates movable groove, 8*a* indicates back side parallel tip formed in the long leg 8*d* of brush tip 8 and 8*b* indicates front side parallel tip.

Besides, brush tip 8 may be formed in a flat shape as in the drawings or in a pole shape or in a hair shape from the short leg 8*c*.

Figure 2:
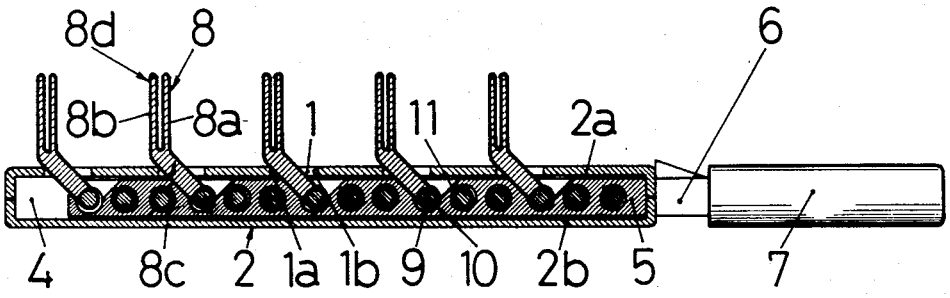
FIGS. 2 and 3 are longitudinal cross-sectional views of the hairbrush of FIG. 1.
Figure 3:
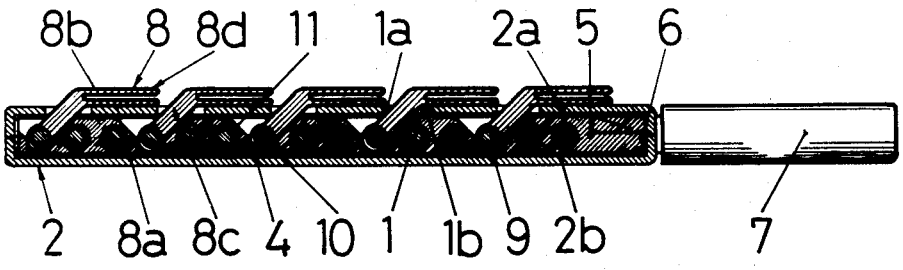
Figure 4:
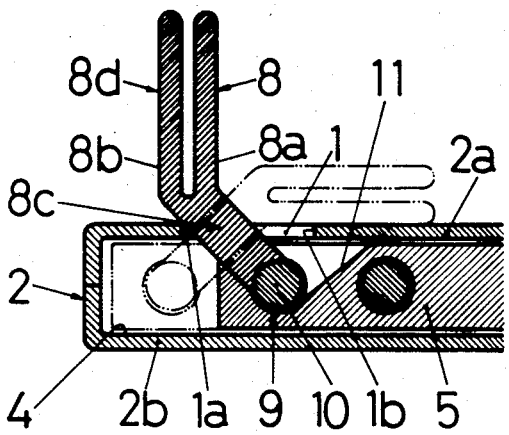
FIG. 4 is a cross-sectional view, partly in section, of hairbrush in operation similiar to FIG. 2.
Figure 5:
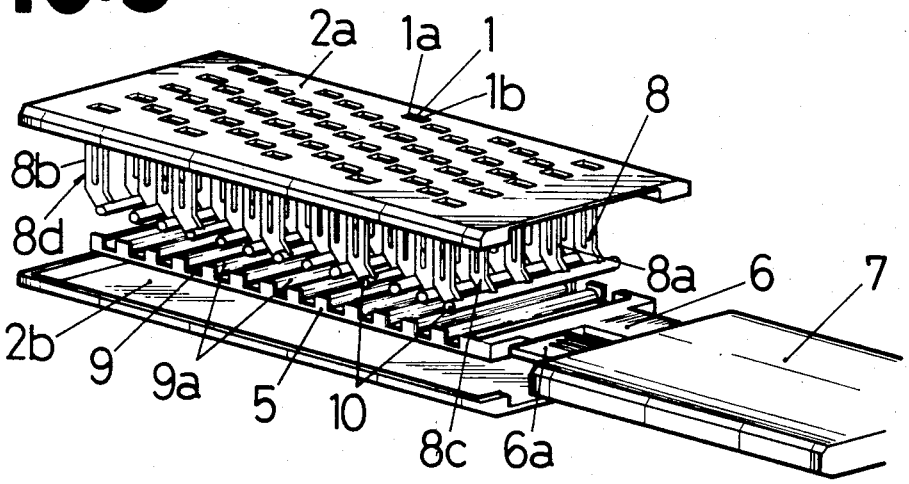
FIG. 5 is a perspective view of detachment of FIG. 1.

Further, stopper 6*a* may be formed to appear or disappear easily by interposition of an unillustrated spring as in the FIGS. 1 through 3 or may be formed to move in or out transversely as in the FIG. 5.

It is desirable for the brush tip 8 to be formed with open or obtuse angle of 120°-150° between the short leg 8*c* and the long leg 8*d*. In case that handle 7 and movable flat board are moved forward and long legs 8*d* of brush tips 8 are pushed down horizontally, drawing back of handle 7 makes the movable flat board move backward in the hollow guided by upper wall 2*a* and lower wall 2*b*. Then on account of the backward movement of axles 10, brush tips 8 rotate while being pushed out. When the long legs 8*d* come to stand vertically, they stop with the front side of brush tip 8*a* engaging with the front wall 1*a* of guide hole 1.

Figure 7:
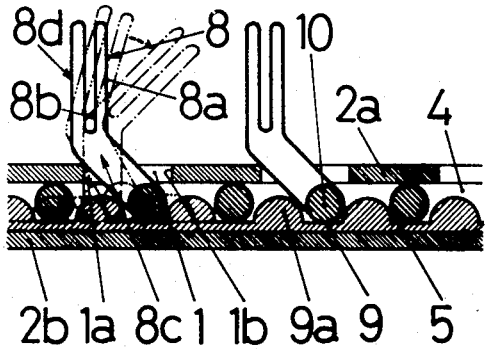

In this manner, when the movable flat board is moved completely backward, the front side of brush tip 8*a* engages with the front wall 1*a* of guide hole 1 and brush tip is fixed in the vertically standing position as in FIGS. 2 and 7. In this case, by the operation of stopper 6*a* which is provided to the rear of the main brush body 2, the movable flat board 5 and handle are prevented from moving forward, and brush tips 8 are vertically secured. The stopper 6*a* which appears or disappears by operation of the spring (not shown in the drawing) is automatically locked along with the backward progress of the movable flat board 5. On the other hand, the stopper 6*a* which moves in or out tranversely must be operated by hand after the movable flat board has been moved backward.

When the handle 7 and movable flat board are moved backward and brush tips 8 stand vertically, the pushing forward of the handle causes the movable flat board to move forward guided by upper wall 2*a* and lower 2*b*.

Figure 6:
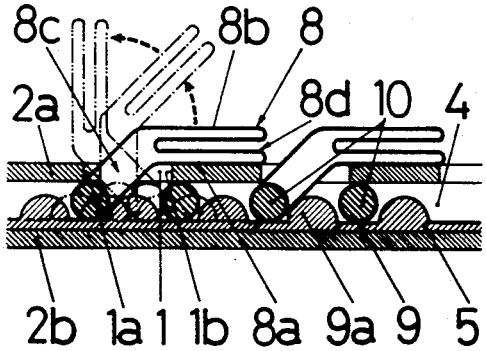
FIGS. 6 and 7 are cross-sectional views, partly in section, of FIGS. 3 and 2 in operation.

Then, axles 10 move forward and brush tips 8 are pushed down by the front walls 1*a* of guide slits and slowly rotate to be stopped flat horizontally as in the FIGS. 3 and 6.

In this way, when the movable flat board 5 is completely moved forward, the back side parallel tip 8*a* of long leg 8*d* is stopped horizontally on the surface of the main brush body.

As a means for coupling the axles 10 to the flat board, it is possible to form a plurality of protrusions 9*a* at equal intervals on the movable flat board as shown in FIG. 5–FIG. 7, and axles 10 may be put between protrusions so as to rotate round freely between protrusions 9*a*.

I claim:

1. A collapsible hairbrush comprising:

a brush body having a hollow interior region comprising an upper cover and a lower base;

a movable flat board which is shorter in length than said hollow interior region and is provided in the hollow interior region so as to move freely back and forth;

a plurality of transverse axles rotatably provided in equal intervals on the movable flat board;

a handle coupled to a base end of the movable flat board by means of a connecting part, said handle and connecting part being axially aligned with said base;

a plurality of guide holes provided in the upper cover so as to form longitudinal slits through which brush tips extend, said brush tips comprising upper long legs and lower short legs, said brush tips forming an obtuse angle between said long and short legs, the bottom ends of the short legs being secured to said axles;

said guide holes having a front wall and a back wall;

a stopper mounted on said connecting part, said stopper being movable within said connecting part so it can be slide inside said hollow brush body, said stopper being movable away from said connecting part when outside of said brush body so as to prevent the handle from being moved in a direction towards said brush body;

whereby said axles may be moved longitudinally back and forth by the handle so that the brush tips are raised up and down by being engaged with the front and rear walls of the guide holes and so that the brush tips can be locked in the raised position when said stopper abuts said brush body.

2. A hairbrush of claim 1 with a pair of transverse protrusions which are placed at equal intervals on an upper surface of the movable flat board, between these protrusions said axles being put in and engage in the movable flat board to be able to rotate freely.

3. A hairbrush of claim 1 with said axles being loosely contained in the movable flat board whereon grooves which afford movement for the brush tips are formed for said axles.

4. A hairbrush of claim 1 with said connecting part being narrower than the main brush body.

5. A hairbrush of claim 1 in which the long legs of the brush tips are U-shaped.

* * * * *